United States Patent [19]

Kojima et al.

[11] Patent Number: 4,882,261

[45] Date of Patent: Nov. 21, 1989

[54] HIGH CONTRAST DOT ENHANCING COMPOSITIONS AND PHOTOGRAPHIC PRODUCTS AND METHODS FOR THEIR USE

[75] Inventors: Yasuhiko Kojima, Fairlawn; John Pilot, Carteret; Burton H. Waxman, Rockaway, all of N.J.

[73] Assignees: Polychrome Corp., Yonkers, N.Y.; Dainippon Ink & Chemicals, Inc., Japan

[21] Appl. No.: 211,980

[22] Filed: Jun. 27, 1988

[51] Int. Cl.[4] ..... G03C 1/06

[52] U.S. Cl. ..... 430/264; 430/446; 430/487; 430/598; 430/614

[58] Field of Search ..... 430/264, 446, 487, 598, 430/614

[56] References Cited

U.S. PATENT DOCUMENTS

| | | | |
|---|---|---|---|
| 4,168,977 | 9/1979 | Takada et al. | 430/446 |
| 4,224,401 | 9/1980 | Takada et al. | 430/437 |
| 4,241,164 | 12/1980 | Mifune et al. | 430/264 |
| 4,269,929 | 5/1981 | Nothnagle | 430/264 |
| 4,278,748 | 7/1981 | Sidhu et al. | 430/212 |
| 4,358,530 | 11/1982 | Shiba | 430/273 |
| 4,385,108 | 5/1983 | Takagi et al. | 430/264 |
| 4,569,904 | 2/1986 | Okutsu et al. | 430/434 |
| 4,650,746 | 3/1987 | Simson et al. | 430/438 |
| 4,681,836 | 7/1987 | Inoue et al. | 430/434 |
| 4,686,167 | 8/1987 | Resnick et al. | 430/264 |

*Primary Examiner*—Paul R. Michl
*Assistant Examiner*—Janet C. Baxter
*Attorney, Agent, or Firm*—Ostrolenk, Faber, Gerb & Soffen

[57] ABSTRACT

Novel dot enhancing compositions are disclosed for use in high contrast negative-working image-forming systems. The compositions include compounds of the general formula:

(I)

wherein $R_1$ is an aromatic group, A is a substituted or unsubstituted aromatic nucleus, and the two carboxyl groups specifically depicted in general formula (I) are each bound to a different carbon atom of said aromatic nucleus.

The dot enhancing compositions may be incorporated into a silver halide photographic emulsion or into another hydrophilic colloid layer of a photographic material, or into a developing solution or, alternatively, into both. The dot enhancers of the invention improve density and contrast of images formed, as well as providing a harder, smoother, better formed dot for use in letter press and offset lithography.

18 Claims, No Drawings

HIGH CONTRAST DOT ENHANCING COMPOSITIONS AND PHOTOGRAPHIC PRODUCTS AND METHODS FOR THEIR USE

BACKGROUND OF THE INVENTION

1. Field of the Invention

One aspect of the present invention relates to dot enhancing compositions for negative working photographic systems. More particularly, certain embodiments of the invention relate to utilization of photographic elements containing novel dot enhancing compositions to improve dot quality in letterpress and offset lithography.

2. Discussion Of The Art

High contrast negative-working silver halide photographic elements, together with film emulsions and appropriate developers are known in the art and are particularly useful in forming half tones in letterpress and offset lithography. Rather than reproducing tones by varying the amount of ink, letterpress and offset lithography conventionally convert halftones into a pattern of small and clearly defined dots, wherein darker tones are formed by increasing dot size and lighter tones by decreasing dot size.

It is highly desirable that each dot display the highest possible optical density and that the dots be well formed with the fringe area around each dot displaying sharp contrast such that optical density drops very quickly as a function of distance from the edge of the dot. This characteristic is often referred to as "edge gradient". A dot with high density and good contrast is said to be a "hard dot".

In addition to the foregoing characteristics, it is also important that the edge of each dot be sufficiently smooth to avoid bridging with neighboring dots when lighter tones are being reproduced. This smoothness may be measured by determining the percentage of darkened surface area on a photographic element at which bridging first occurs. It is desirable for dot smoothness to substantially avoid bridging at less than 40 percent and more preferably 45 percent or as close to 50 percent as possible. Avoidance of bridging near the 50 percent level requires a smooth and well-formed dot. A hard dot which also achieves high smoothness enables high accuracy tone reproduction needed in the industry.

In the prior art, various hydrazines, particularly formyl hydrazines, have been used as developing agents in order to enhance dot quality. It is believed that these prior art compounds promote infectious development and desirably increase density and contrast. Formyl phenylhydrazines and various aryl formyl hydrazides have been utilized as part of the photographic film emulsion in hydrophilic colloid layers of negative working photographic materials, and it has occasionally been suggested that they be used as part of a developing solution. Systems using these prior art compounds have succeeded in producing dots with good density and contrast. However, these dots do not necessarily display the smoothness necessary for highly accurate tone reproduction.

Another problem with prior art systems is the undesirable occurrence of "pepper effect", which may result when silver is undesirably reduced in the absence of exposure of film to light. Hence, dark spots or "pepper" may appear at unexposed positions on the film which should not be darkened. In many prior art systems this effect may become more pronounced over time as developing solutions are broken down by contact with atmospheric oxygen. A problem with prior art systems is that high density and good contrast have been difficult to achieve while simultaneously providing smooth edges and retarding pepper effect.

SUMMARY OF THE INVENTION

It is accordingly an object of the present invention to provide novel high contrast developing agents.

It is another object of the invention to provide novel nucleating agents capable of producing hard dots in letterpress and offset lithography applications.

It is another object of the invention to provide high quality dots having good edge smoothness.

It is another object of the invention to provide photographic elements capable of producing hard well-formed dots with a minimum of pepper effect.

These and other objects are accomplished by providing a dot enhancing agent comprising an effective amount of a compound having the general formula:

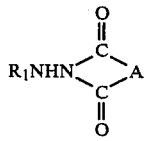

(I)

wherein $R_1$ is an aromatic group and A is a substituted or unsubstituted aromatic nucleus, and wherein each of the two carboxyl groups specifically depicted in said general formula (I) is bound to a different carbon atom of said aromatic nucleus. In certain preferred embodiments, a negative-working photographic element is provided with at least one of the novel dot enhancing agents of the invention, preferably in one or more hydrophilic colloid layers of said photographic element.

In other preferred embodiments, an imageforming process is provided which comprises image-wise exposing to light a photographic light-sensitive material comprising at least one silver halide photographic emulsion layer and contacting said exposed photographic material with a developer, wherein said contacting occurs in the presence of an effective amount of a dot enhancing agent of the above general Formula (I).

Applicants have surprisingly found that when the novel nucleating agents disclosed herein are added to, or substituted for, the hydrazines utilized in the prior art, peppering is reduced. Particular improvement over prior art systems is observed after the developing solution has had extended contact with atmospheric oxygen, a situation which tends to greatly increase peppering in the prior art. Moreover, dots formed in accordance with the invention show excellent edge smoothness as evidenced by a substantial lack of bridging between dots at tones reproduced as high as 45 percent dot. This is accomplished without decreasing the stability of the film emulsions or of the developing solutions, and without increasing necessary exposure time.

The effectiveness of the compositions of the invention in enhancing density, contrast, smoothness and overall dot quality is surprising and unexpected in view of teachings in the relevant art. For instance, in Kitchin et al., "An Improved Process for HydrazinePromoted Infectious Development of Silver Halide", *J. Photog. Sci.*, Vol. 35 (1987), pp. 162–64, a hypothetical mechanism is set forth for the contrast-promoting infectious development attributed to certain formyl hydrazine compounds of the prior art. The proposed mechanism involves the oxidation of the hydrazine to a corresponding diimide derivative having the structure R—N=N—CHO. In contradistinction, the N,N-diacyl tertiary nitrogen compounds of the invention would not be expected to undergo oxidation to such a diimide derivative. Without intending to be bound by theory, experimental data indicates that the mechanism of the N,N-diacyl compounds of the invention does not involve a preliminary hydrolysis of the compound into a hydrazine which could then be oxidized to the diimine derivative suggested by Kitchin et al. The structure

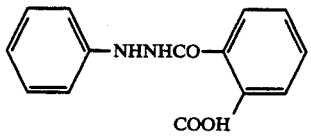

II-4 a hydrolysis product of a preferred dot enhancing agent of the invention and has not proven to be an effective dot enhancer or contrast promoter as would be expected if the mechanism of the invention involved a preliminary hydrolysis step.

Another art reference (Nothnagle, U.S. Pat. No. 4,269,929) suggests that electron withdrawing hydrazine substituents should be avoided. See Column 4, line 23 to Column 5, line 10. See also Simson, U.S. Pat. No. 4,650,746, Col. 2, lines 11–41. Presumably, such electron withdrawing substituents could retard oxidation. Despite art references tending to suggest that ability to undergo oxidation is important to contrast promoting agent, the compounds of the invention would not be expected to readily undergo oxidation. Yet they exhibit excellent and surprising effectiveness.

Some tertiary diacyl derivatives do not perform within inventive parameters. When the aromatic compounds of the invention are replaced by non-aromatic analogs (on the carbonyl side of the structure) as in structures II-5 and II-6 infra, infections development was not observed even at high levels of nucleator incorporation.

DETAILED DESCRIPTION OF CERTAIN PREFERRED EMBODIMENTS

In certain embodiments of the invention, the novel dot enhancing compositions are incorporated into a photographic film.

In especially preferred embodiments, the compositions include a compound having the following general structure:

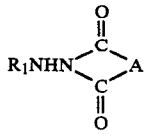

(I)

Preferred substituents at the $R_1$ position in general Formula I above include but are not limited to monocyclic aryl groups, dicyclic aryl groups, heterocyclic groups, heteroaryl groups and substituted analogs of the foregoing. Especially preferred are benzene, naphthalene, pyridine, pyrimidine, imidazole, pyrazole, thiazole, benzothiazole, benzimidazole, indazole, quinoline, isoquinoline and substituted analogs of the foregoing.

Preferred examples of A in Formula I is a substituted or unsubstituted aromatic nucleus which includes but is not limited to monocyclic aryl groups, dicyclic aryl groups, heterocyclic groups, heteroaryl groups and substituted analogs of the foregoing. Especially preferred are benzene, naphthalene, pyridine, pyrimidine, indazole, quinoline, isoquinoline and substituted analogs of the foregoing.

The most preferred compositions include compounds having the following general structure:

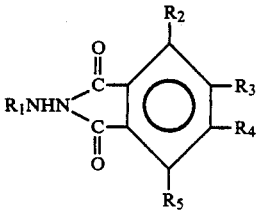

(II)

wherein $R_1$ is as described above for Formula I, and $R_2$ through $R_5$ include, but are not limited to: alkylamino, acyl, amino-acyl, alkylaminoacyl, carboalkoxy, alokoxy, hydroxy, acyloxy, carboxylic acid, phenyl, hydrogen, nitro, halogen, or may be cyclized to form an aromatic or heteroaromatic group.

Preferred dot enhancing compounds for use in the dot enhancing compositions, products and methods of the invention include, but are not limited to Compounds listed below.

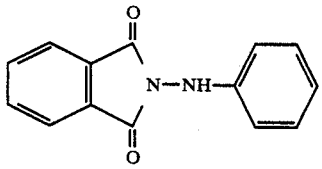

I-1

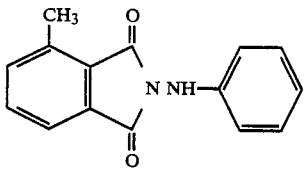

I-2

-continued
I-3
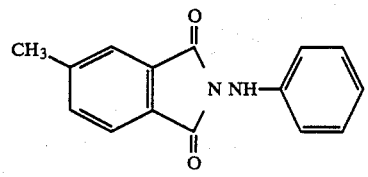
I-4
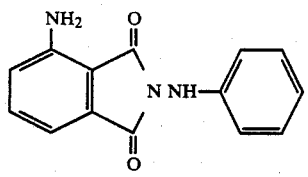
I-5
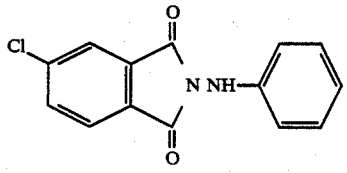
I-6
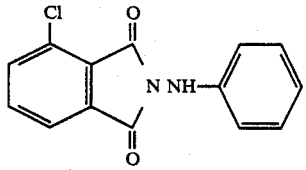
I-7
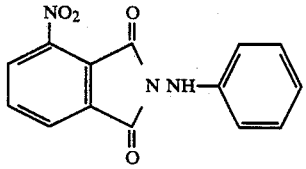
I-8
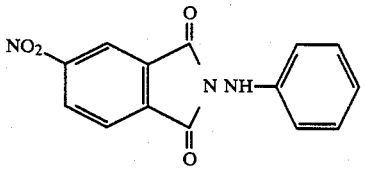
I-9
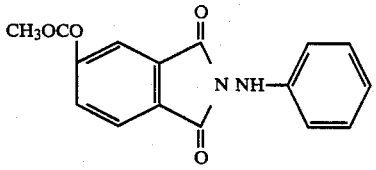
I-10
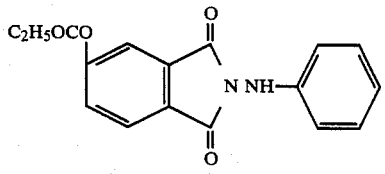
I-11
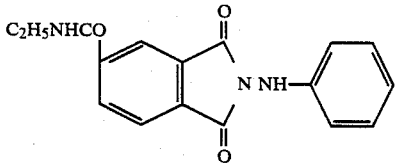

-continued
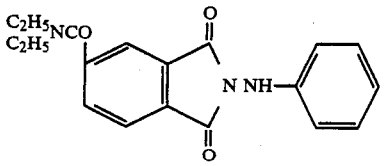
I-12
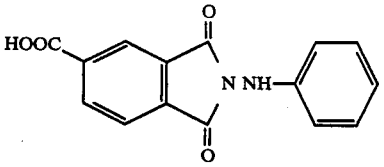
I-13
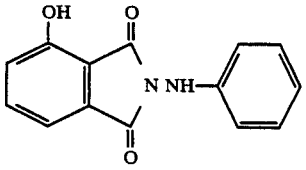
I-14
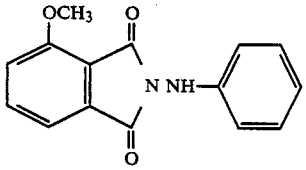
I-15
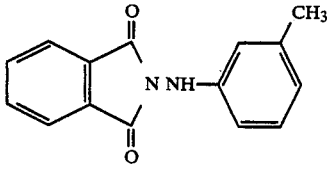
I-16
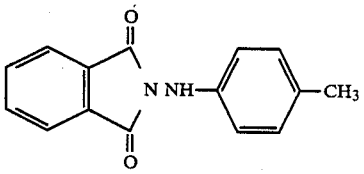
I-17
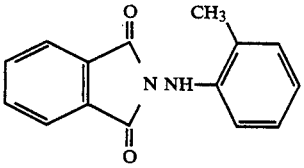
I-18
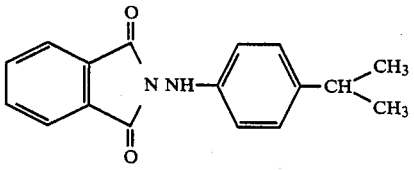
I-19
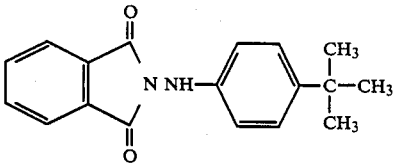
I-20

-continued
I-21
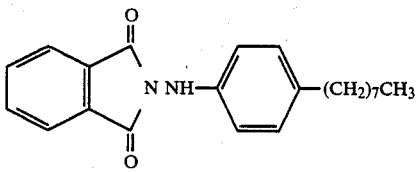
I-22
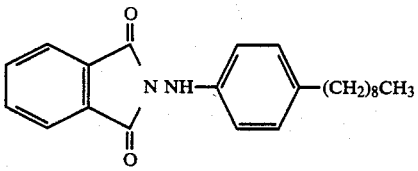
I-23
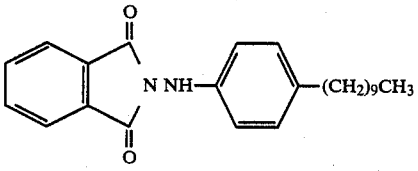
I-24
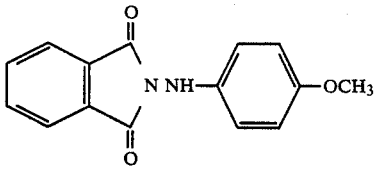
I-25
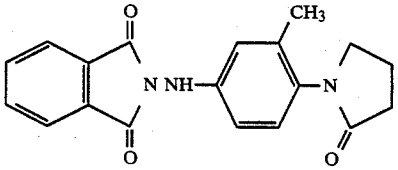
I-26
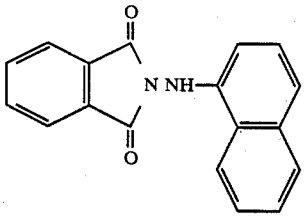
I-27
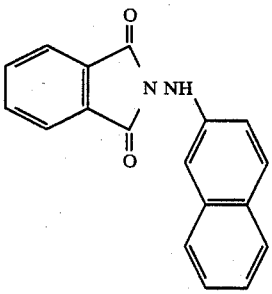
I-28
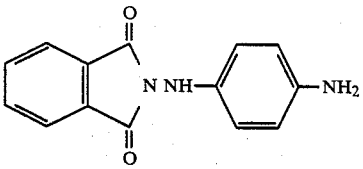

-continued
I-29
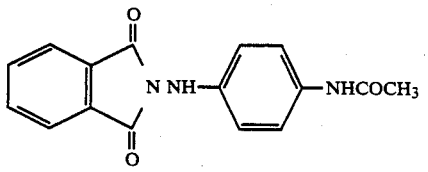
I-30
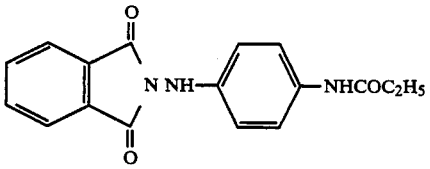
I-31
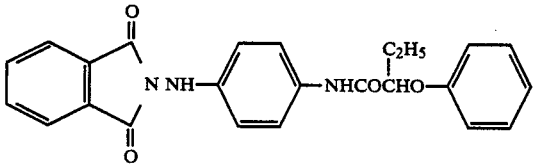
I-32
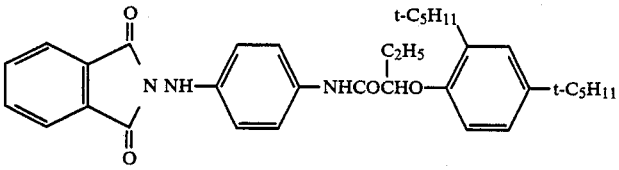
I-33
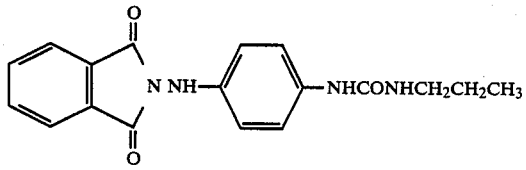
I-34
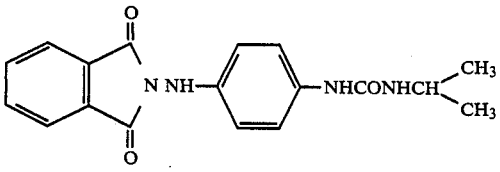
I-35
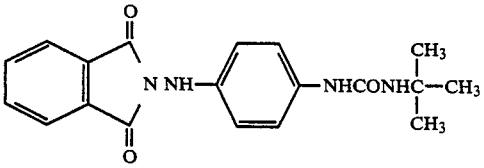
I-36
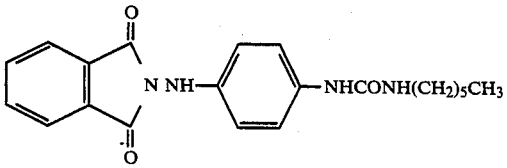
I-37
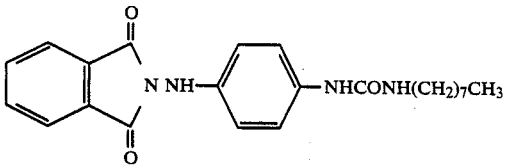

-continued
I-38
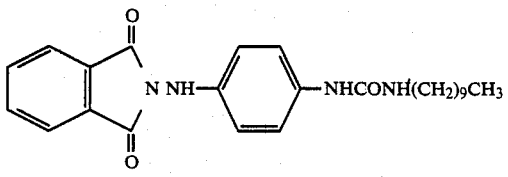
I-39
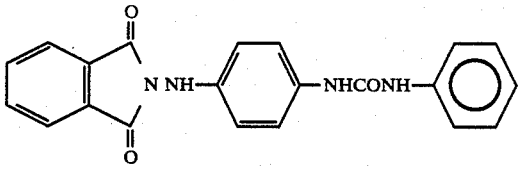
I-40
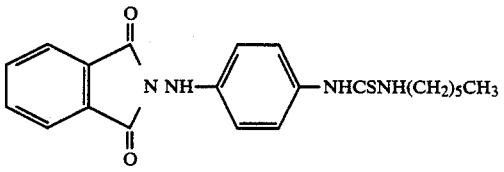
I-41
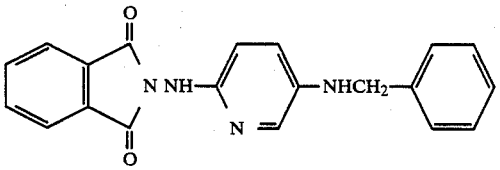
I-42
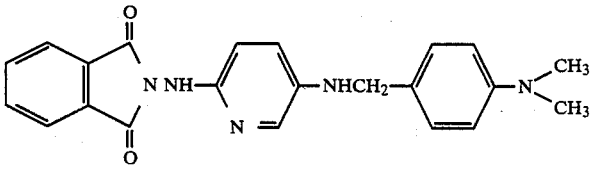
I-43
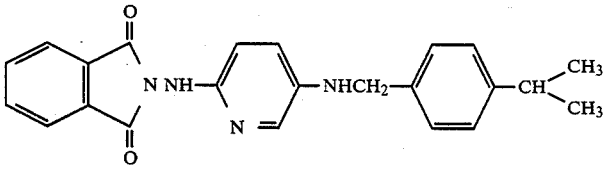
I-44
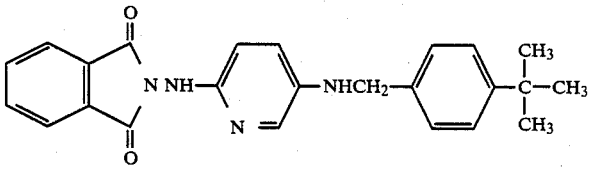
I-45
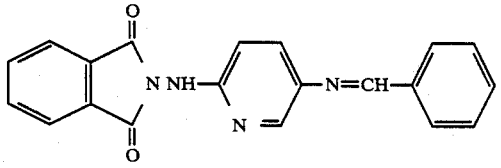
I-46
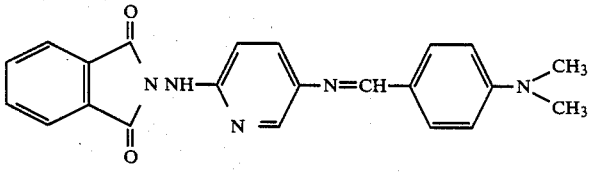

-continued
I-47
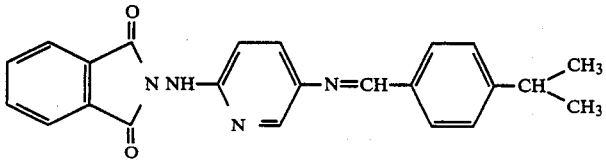
I-48
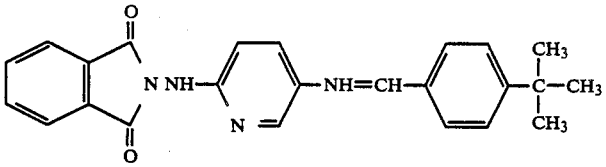
I-49
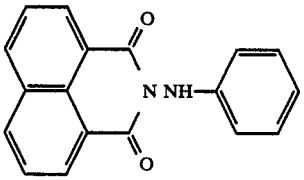
I-50
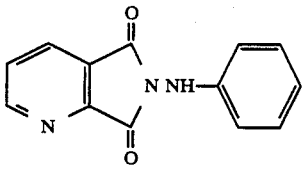
I-51
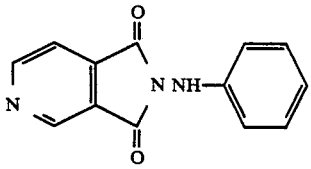
I-52
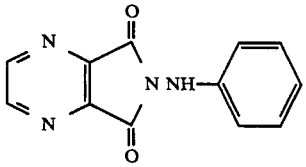
COMPARATIVE COMPOUNDS
II-1
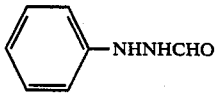
II-2
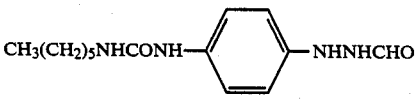
II-3
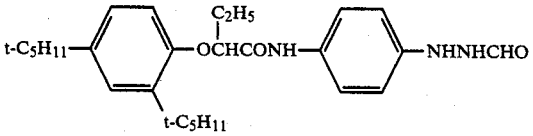
-continued
II-4
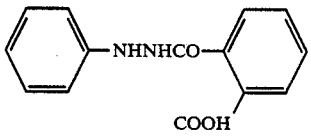
II-5
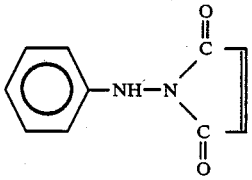

-continued

II-6

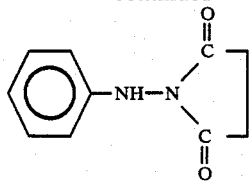

In accordance with the invention, one or more dot enhancing compositions, having an effective amount of at least one compound represented by Formula (I) above, are preferably added into a sulfur or sulfur-gold sensitized photographic emulsion at a concentration from about $10^{-5}$ moles per mole of silver to about $10^{-1}$ moles per mole of silver. About $10^{-3}$ is especially preferred. N-phenylamino-phthalimide has proven to be effective and may be synthesized for instance by the following two reactions (M. Z. Barakat, S. K. Shehab and M. M. El-Sadr, J. Chem. Soc., 3299 (1955); F. M. Rowe, J. G. Gillan and A. T. Peters, J. Chem. Soc., 1808 (1935)).

Reaction 1

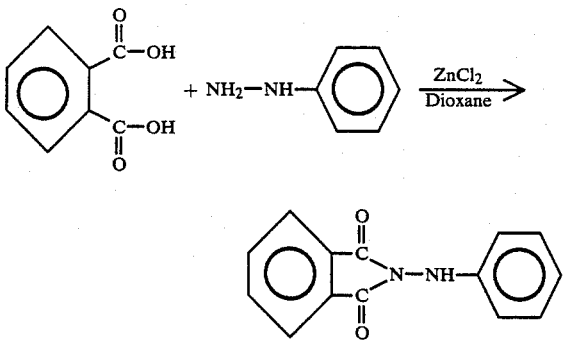

Reaction 2

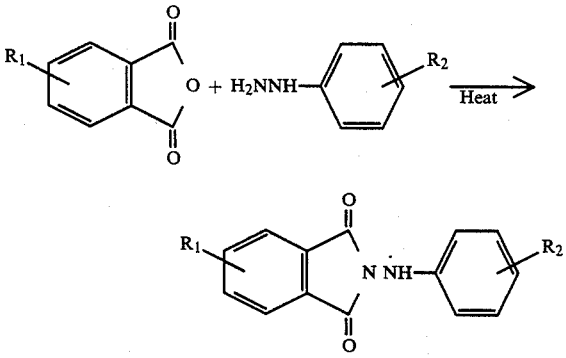

Analogous reactions of hydrazines with dicarboxylic acids or phthalic anhydrides, wherein the hydrazines, acids, or anhydrides are first modified with desired substituents by conventional techniques may be utilized to obtain other Formula (I) compounds useful in the dot enhancing compositions of the invention. Alternatively, some substituents may be added after reacting the acid or anhydride with the hydrazine rather than before.

Preferably, a photographic light sensitive material for use in accordance with the invention comprises a support which has at least one silver halide photographic emulsion layer thereon. The support is preferably a flexible material having a thickness of about 3 to 7 microns. In many applications the material is substantially clear, although some applications desirably utilize a pigmented support. The support is preferably a plastic material such as a polyester, polycellulose acetate, polystyrene or polyethylene. These materials are preferably surface modified to better accept a surface coating of a aqueous gelatinous material. It is desirable to add an antihalation material to the back side of the support, i.e., that side which is not to receive photographic emulsion. This antihalation layer retards curling of the support which would otherwise be expected upon coating one side with an aqueous emulsion, and acts to avoid actinic flair.

The silver halide layer preferably comprises substantially surface latent image type monodispersed silver halide grains having an average grain size of less than about 1 micron and preferably less than about 0.7 microns in a common photographic binder. Appropriate silver halides include but are not limited to silver chloride, silver chlorobromide, silver bromide, silver iodobromide and mixtures thereof. One or more compounds within the scope of general Formula (I) are added to the emulsion. It is preferred that the concentration of these compounds in the emulsion be from about 10–5 to about 10–1 mole per mole silver. The emulsion is desirably treated with known additives such as stabilizers and the like, and applied to a substantially uniform depth on the substrate, preferably a depth between about 20 and 100 microns in wet thickness which dries to a layer of about 2 to 10 microns, preferably about 5 microns. It is desirable to apply an overcoat to provide an antiabrasion layer, said overcoat having a hardener. Hardeners may also be applied to the emulsion formulation.

Dot enhancing compositions of the invention and products containing them may, if desired, include infectious development promoters such as the hydrazines of the prior art. However, common hydrazine compounds such as the aryl formyl hydrazines typical of the prior art are not necessary. The dot enhancing compositions of the invention are being specifically described as part of the photographic light-sensitive material, but may alternatively be used as part of the developing solution, or in both developer and photographic material.

Preferred methods of utilizing the novel dot enhancing compositions of the invention involve incorporating said dot enhancing compositions into one or more hydrophilic colloid layers of a photographic element as described above, image-wise exposing said element to light and then developing said exposed photographic elements in a conventional manner, normally by contacting the exposed element for about 30 to 60 seconds with an appropriate developing solution. Appropriate developing solutions preferably contain one or more of the following:

an effective amount of a sulfite preservative a contrast-promoting amount of an amino compound, especially a methylamino-substituted hydroxy benzene dihydroxybenzene.

The invention is further illustrated by the following examples which are set forth by way of illustration only and not by way of limitation.

EXAMPLE 1

A cubic, mono-dispersed silver bromide emulsion having an average grain size of 0.25 microns was prepared by a balanced double jet technique by simultaneously adding solutions of 2 normal silver nitrate and 2 normal potassium bromide into a 3 percent aqueous gelatin solution at a temperature of 60° C. over a period of 60 minutes while maintaining the pAg at 7.0. After the soluble salts were removed by coagulation and washing, the emulsion was reconstituted to a 12% silver analysis and 6% gelatin concentration. The emulsion was chemically sensitized for 70 minutes at 56° C. using sodium thiosulfate at $2.5\times10^{-4}$ mole/mole of silver. After sensitization, the emulsion was treated with 6-hydroxy-4-methyl-1,3,3a,7-tetrazaindene at $1.25\times10^{-2}$ mole/mole silver. The resulting emulsion was substantially of the surface latent image type, and internal sensitivity relative to the surface was negligible. The emulsion was spectrally sensitized by treating with $3.2\times10^{-4}$ mole/mole of anhydro-5,5'-dichloro-9-ethyl-3,3'-bis-(3-sulfopropyl)-oxacarbocyanine triethylammonium salt.

The test compounds were then added at the levels listed in Table 1. after adding sodium dioctyl sulfosuccinate as a coating aid at 0.7 g/mole, the emulsion was coated onto a polyester substrate at a coating weight of 40 milligrams of silver per square decimeter. The emulsion was overcoated with an aqueous gelatin antiabrasion layer containing a formaldehyde hardener. After drying, the resulting film was exposed to a 2666K tungsten light for 20 seconds through a 2 Log E continuous tone wedge, and an identical wedge which was interposed with a gray, negative, elliptical dot screen of 133 lines per inch. Samples were processed in developers whose formulations are listed in Table 2. The sensitometry which was obtained are included in Table 1.

EXAMPLE 2

Cubic, mono-dispersed silver bromide or iodobromide emulsions of 0.25 micron crystal size were prepared as described in Example 1, but rhodium was included in the halide feed stream as its hexabromo complex. The chemical sensitization was performed at 55° to 60° C. for 70 minutes using gold trichloride at $5\times10^{-5}$ mole/mole in combination with sodium thiosulfate at $2.5\times10^{-4}$ mole/mole. Compound 1 was added at a level of $3\times10^{-3}$ mole/mole. The remainder of the photographic work-up, exposure, and processing were as described in Example 1. The sensitometric data are included in Table 3, and are compared to results obtained using an emulsion as prepared in Example 1.

EXAMPLE 3

Synthesis of N-Phenylamino-phthalimide

Phthalic acid (1.66 gram, 0.01 mole), phenylhydrazine (1.08 gram, 0.01 mole), and zinc chloride (3.0 gram, 0.022 mole) were added into 50 ml. of dioxane. After refluxing for 2 hours, the mixture was cooled to room temperature. The solvent was then removed and the residue was poured into ice-water which precipitated a yellow solid. After recrystallization from methanol, the pure compound was obtained in 30% yield as yellow needles (0.7 grams; m.p. 180° C.).

EXAMPLE 4

Synthesis of N-(phenylamino)-4-methylphthalimide

A solution of phenylhydrazine (1.08 gram, 0.01 mole) in 10 ml. of nitrobenzene was added dropwise into a solution of 4-methylphthalic anhydride (1.62 gram, 0.01 mole) in 20 ml. of nitrobenzene. The mixture was warmed to 150° C. for 30 minutes and then 50 ml. of toluene was slowly added. The water was azeotropically removed by distillation of the toluene. The mixture was then cooled and poured into a large volume of petroleum ether. The powder which precipitated was removed by filtration. After recrystallization from methanol, pure product was obtained as yellow needles in 60% yield (1.5 grams; m.p. 168°-170° C.).

TABLE

Test Results for Example 1

| Test Compound | | Developer | B + F | Dmax | Speed | Gradient (f) | | Pepper | Dot Quality |
|---|---|---|---|---|---|---|---|---|---|
| Number | Amount (a) | (b) | (c) | (d) | (e) | G-1 | G-2 | (g) | (h) |
| None | — | A | 0.03 | 5+ | 117 | 1.6 | 5.1 | 0 | 5 |
| None | — | B | 0.03 | 4.6 | 66 | 1.2 | 4.8 | 0 | 5 |
| I-1 | $3.0\times10^{-3}$ | A | 0.03 | 5+ | 550 | 13.1 | 28.7 | 0 | 1 |
| I-1 | $3.0\times10^{-3}$ | B | 0.03 | 5+ | 308 | 8.8 | 14.1 | 0 | 1 |
| I-17 | $2.0\times10^{-3}$ | A | 0.04 | 5+ | 561 | 9.2 | 23.7 | 0 | 1 |
| I-17 | $2.0\times10^{-3}$ | B | 0.04 | 5+ | 285 | 5.3 | 11.0 | 0 | 1 |
| I-24 | $1.0\times10^{-3}$ | A | 0.05 | 5+ | 650 | 6.4 | 16.6 | 6 | 2 |
| I-36 | $7.5\times10^{-4}$ | A | 0.03 | 5+ | 650 | 4.4 | 25.8 | 3 | 1 |
| II-1 | $5.0\times10^{-3}$ | A | 0.03 | 5+ | 620 | 6.8 | 32.7 | 0 | 3 |
| II-1 | $5.0\times10^{-3}$ | B | 0.03 | 5+ | 360 | 33.6 | 43.1 | 50 | 2 |
| II-2 | $5.0\times10^{-5}$ | A | 0.03 | 5+ | 432 | 7.1 | 29.3 | 45 | 1 |
| II-2 | $5.0\times10^{-5}$ | B | 0.03 | 5+ | 352 | 4.9 | 8.9 | 90 | 4 |
| II-3 | $4.0\times10^{-3}$ | A | 0.03 | 5+ | 610 | 8.5 | 18.0 | 10 | 1 |
| II-4 | $5.0\times10^{-3}$ | A | 0.04 | 5+ | 220 | 2.0 | 6.9 | 0 | 5 |
| II-5 | $1.0\times10^{-2}$ | A | 0.05 | 5+ | 124 | 1.8 | 4.4 | 0 | 5 |
| II-6 | $1.0\times10^{-2}$ | A | 0.05 | 5+ | 156 | 1.8 | 5.1 | 0 | 5 |

Notes:
(a) Moles of compound per mole of silver
(b) See Table 2 for developer formulation and conditions of development
(c) Base plus fog
(d) Maximum density
(e) Expressed arithmetically as the anti-logarithm of 3 minus the relative log exposure at an optical density of 0.5 above base plus fog.
(f) G-1 is the gradient from 0.1 to 0.5 density; G-2 from 0.5 to 3 density.
(g) Expressed in terms of the average number of pepper spots observed in a 1 square centimeter area in a non-exposed, but developed portion of the film.
(h) Expressed on a scale ranging from 1 to 5, with 1 being excellent (i.e., conventional lith type quality), 3 being fair (i.e., conventional rapid access lith quality), and 5 being poor (i.e., continuous tone quality).

TABLE II

Developers Used to Evaluate Test Compounds

| Ingredient | Developer A | Developer B |
|---|---|---|
| Distilled Water | 700 grams | 700 grams |
| p-Methylaminophenol sulfate | — | 1 grams |
| Sodium Sulfite, Anhy. | 75 grams | 50 grams |
| Dipotassium Phosphate | — | 87.1 grams |
| Sodium meta-Borate Octahydrate | — | 29.9 grams |
| Sodium Bicarbonate | 7 grams | — |
| Potassium Bromide | 3.5 grams | 5 grams |
| EDTA, Na—2 (a) | 1 grams | 3 grams |
| 2-Diethylaminoethanol | 46.8 grams | — |
| 3-Diethylamino-1,2-propanediol | — | 22 grams |
| 5-Methylbenzotriazole | 0.8 grams | 1.2 grams |
| 5-Nitroindazole | — | 0.1 grams |
| Hydroquinone | 40 grams | 40 grams |
| Phenidone | 0.5 grams | — |
| Potassium Hydroxide | To pH 11.5 | To pH 12.0 |
| Distilled Water | To 1.0 liter | To 1.0 liter |
| Development Temperature | 32 C. | 38 C. |
| Development Time | 40 sec. | 40 sec. |

Notes:
(a) Ethylene diamine tetra-acetic acid, di-sodium salt.

TABLE III

Evaluation of Compound I-1 in Different Emulsions (a)

| Emulsion | | B + F | Dmax | Speed (e) at 0.5 | Gradient (f) | | Pepper | Dot Quality |
|---|---|---|---|---|---|---|---|---|
| Halide Type | Rh (b) | (c) | (d) | Density | G-1 | G-2 | (g) | (h) |
| 100% Bromide | None | 0.05 | 5+ | 500 | 9.5 | 17.4 | 0 | 1 |
| 100% Bromide | 1500 | 0.09 | 4.6 | 975 | 2.4 | 15.4 | 0 | 1 |
| 2% Iodo-Bromide | 1200 | 0.05 | 4.8 | 281 | 6.6 | 13.8 | 2 | 2 |

Notes:
(a) Processed in Developer A.
(b) Rhodium content in nano-moles per mole silver.
(c) Base plus fog
(d) Maximum optical density
(e) Expressed in arithmetic form as the anti-logarithm of 3 minus the relative Log exposure.
(f) G-1 is the gradient from 0.1 to 0.5 density; G-2 from 0.5 to 3 density.
(g) Pepper expressed in same terms as in Table 1.
(h) Dot quality expressed in same terms as in Tables 1.

What is claimed is:

1. A photographic light sensitive material comprising a support having thereon at least one silver halide photographic emulsion layer, said photographic light sensitive material further comprising an effective amount of a dot enhancing agent of the general formula:

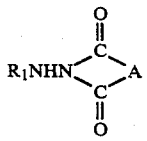

(I)

wherein $R_1$ is an aromatic group and A is a substituted or unsubstituted aromatic nucleus, and wherein each of the two carboxyl groups specifically depicted in said general formula (I) is bound to a different carbon atom of said aromatic nucleus.

2. The photographic material according to claim 1, wherein said dot enhancing agent is present in a hydrophilic colloid layer of said photographic material.

3. The photographic material according to claim 1, wherein said silver halide is a substantially surface latent image-type monodispersed silver halide and is selected from the group consisting of silver chloride, silver chlorobromide, silver bromide and silver iodo-bromide.

4. The photographic material according to claim 1, where $R_1$ is selected from the group consisting of monocyclic aryl groups, dicyclic aryl groups, heteroaryl groups and substituted analogs of the foregoing.

5. The photographic material according to claim 1, wherein $R_1$ is selected from the group consisting of benzene, naphthalene, pyridine, pyrimidine, imidazole, pyrazole, thiazole, benzothiazole, benzimidazole, indazole, quinoline, isoquinoline and substituted analogs of the foregoing.

6. The photographic material according to claim 1, wherein $R_1$ is a benzene ring-containing substituent.

7. The photographic material according to claim 1, wherein said dot enhancing agent has the general formula:

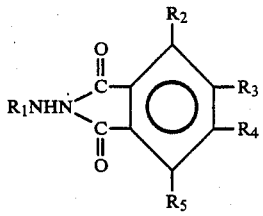

(II)

wherein $R_1$ is a substituted or unsubstituted aromatic group, and wherein $R_2$, $R_3$, $R_4$ and $R_5$ are independently selected from the group consisting of hydrogen, substituted or unsubstituted alkyl, amino, acylamino, alkylamino, acyl, amino-acyl, alkylaminoacyl, carboxylic acid, phenyl, nitro, halogen; or $R_2$, $R_3$, $R_4$, $R_5$, or a combination of any of them, may form an aromatic, heteroaromatic, or other cyclic moiety.

8. An image-forming process which comprises imagewise exposing to light a photographic light-sensitive material comprising at least one silver halide photographic emulsion layer and contacting said exposed photographic material with a developer, wherein said contacting occurs in the presence of an effective amount of a dot enhancing agent of the general formula:

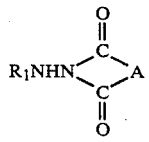

(I)

wherein $R_1$ is an aromatic group and A is a substituted or unsubstituted aromatic nucleus, and wherein each of the two carboxyl groups specifically depicted in said general formula (I) is bound to a different carbon atom of said phenyl nucleus.

9. The method according to claim 8, wherein $R_1$ is selected from the group consisting of monocyclic aryl groups, dicyclic aryl groups, heteroaryl groups and substituted analogs of the foregoing.

10. The method according to claim 8, wherein $R_1$ is selected from the group consisting of benzene, naphthalene, pyridine, pyrimidine, imidazole, pyrazole, thiazole, benzothiazole, benzimidazole, indazole, quinoline, isoquinoline and substituted analogs of the foregoing.

11. The method according to claim 8, wherein $R_1$ is a benzene ring-containing substituent.

12. The method according to claim 8, wherein said dot enhancing agent has the general formula:

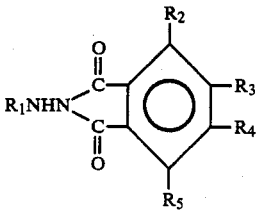

(II)

wherein $R_1$ is a substituted or unsubstituted aromatic group, and wherein $R_2$, $R_3$, $R_4$ and $R_5$ are independently selected from the group consisting of hydrogen, substituted or unsubstituted alkyl, amino, acylamino, alkylamino, acyl, amino-acyl, alkylaminoacyl, carboxylic acid, phenyl, nitro, halogen; or $R_2$, $R_3$, $R_4$, $R_5$, or a combination of any of them, may form an aromatic, heteroaromatic, or other cyclic moiety.

13. The method according to claim 8, wherein said developer includes an effective amount of a sulfite preservative.

14. The method according to claim 8, wherein said developer includes a contrast promoting amount of an amino compound.

15. The method according to claim 8, wherein said developer includes dihydroxybenzene.

16. The method according to claim 11, wherein said developer includes dihydroxybenzene, a contrast-promoting amount of an amino compound and an effective amount of a sulfite preservative.

17. The method according to claim 16, wherein said amino compound is a methylamino-substituted hydroxybenzene.

18. The method according to claim 8, wherein said dot enhancing agent is present in at least one hydrophilic layer of said film.

* * * * *